United States Patent [19]

Naz

[11] 4,104,841

[45] Aug. 8, 1978

[54] ROOFING OR SIDING SLAT ASSEMBLY WITH PROTECTIVE HINGE-FORMING GROOVE

[76] Inventor: Paul Naz, 20502 Harper, Harper Woods, Mich. 48225

[21] Appl. No.: 813,444

[22] Filed: Jul. 7, 1977

[51] Int. Cl.[2] ..... E04D 1/00

[52] U.S. Cl. ..... 52/519; 52/531; 52/547; 52/551

[58] Field of Search ..... 52/573, 529, 530, 531, 52/542, 543, 536, 545, 547, 551, 544

[56] References Cited

U.S. PATENT DOCUMENTS

| | | | |
|---|---|---|---|
| 1,121,594 | 12/1914 | Probert | 52/529 |
| 1,630,019 | 5/1927 | Leonard | 52/545 |
| 1,700,138 | 1/1929 | Murray | 52/531 |
| 2,075,676 | 3/1937 | Toney | 52/543 |
| 3,110,130 | 11/1963 | Trachtenberg | 52/545 |
| 3,158,960 | 12/1964 | Newton et al. | 52/545 |
| 3,301,430 | 1/1967 | Cornelius | 16/150 |
| 3,581,450 | 6/1971 | Patry | 52/403 |

FOREIGN PATENT DOCUMENTS

| | | | |
|---|---|---|---|
| 18,482 | 8/1911 | United Kingdom | 52/542 |

*Primary Examiner*—Price C. Faw, Jr.

*Assistant Examiner*—Henry Raduazo

*Attorney, Agent, or Firm*—Cullen, Settle, Sloman & Cantor

[57] ABSTRACT

An interlocking siding or roofing strip or slat assembly for covering the surface of a building which may be susceptible of being crushed or deformed by the application of excessive force to a fastening element such as a nail. The slat assembly includes a fastening tab, a panel, an anchoring configuration intermediate the panel and the fastening tab and a hook-like configuration integral with the bottom of the panel for operatively engaging the anchoring configuration of a previously-installed slat assembly for interlocking them one above the other in a partially overlapping manner. The fastening tab and the anchoring configuration are interconnected and the interconnection includes a lateral groove extending substantially the entire width of the panel and having a depth of approximately one-half of its thickness for forming a hinge-type protective joint therebetween for isolating the panel for buckling and the other effects of deformation and distortion in the fastening tab and building surface such as that caused by the excessive application of force to the fastening elements securing the fastening tab to the building surface.

10 Claims, 6 Drawing Figures

ROOFING OR SIDING SLAT ASSEMBLY WITH PROTECTIVE HINGE-FORMING GROOVE

BACKGROUND OF THE INVENTION

The invention relates to a siding or roofing strip or slat assembly and more particularly to an interlocking slat assembly utilizing a hinge-forming groove for isolating the panel portion of the assembly from distortions and deformations produced in the fastening strip and building surface from the excessive application of force to the fastening elements and the like.

The prior art teaches many different types of interlocking siding sheets for protectively and/or decoratively covering the inside and/or outside walls of a building or the trim portions thereof. Similarly, the prior art teaches many different types of interlocking roofing strips or shingles adapted to be secured to the roof portion of a building in a partially overlapping manner, one above the other.

The prior art siding or roofing strips or slat assemblies which are capable of interlocking are often relatively complex structures which are relatively expensive to make and difficult to install and maintain. Most of the siding or roofing strips of the prior art becomes loose with age or through exposure to variations in the weather since both of these conditions may result in expansions and contractions of the siding or roofing strips themselves, of the fastening elements used to anchor the strips, and/or of the material from which the surface of the building being covered is made.

When roofing or siding strips become loose, they can fall off leaving an unsightly blemish and an unprotected area on the previously covered surface of the building. Water or the like may run under the roofing or siding and into the house causing property damage. Another major problem of the prior art siding or roofing strips is that of noise. When the roofing and/or siding strips became loose, even a gentle breeze could cause a whistling or rattling of the strips much to the annoyance of the inhabitants of the building and those in the immediate vicinity thereof.

None of the roofing and/or siding strips of the prior art, which are commercially feasible when cost considerations are taken into account, provide a means to prevent the slat assemblies from coming loose with age and exposure to the elements and none provide means whereby the strip may automatically compensate for expansions and contractions. One solution to these problems was suggested in my co-pending application, U.S. Ser. No. 762,847, entitled "SELF-COMPENSATING SIDING OR ROOFING STRIP", which was filed on Jan. 27, 1977 and another solution was suggested in my co-pending patent application, U.S. Ser. No. 801,229, entitled "SELF-COMPENSATING TWO-PIECE SIDING OR ROOFING SLAT", which was filed on May 27, 1977. Both of these patent applications are incorporated by reference herein.

A further problem which does not find a solution in the prior art is that of buckling or other undesirable distortions or disfigurations caused in the siding panel when the fastening tab or nailing tab and/or the building surface to which it is attached, for example, a $\frac{5}{8}$ inch foam insulation board, may be crushed or deformed when excessive nailing pressure is applied to the fastening elements used to secure the nailing tab to the surface. This may cause the building surface to crush, the nailing tab to deform, or otherwise cause an unevening of the supporting surface for the siding thereby causing the panel portion of the slat assembly to buckle or otherwise assume an irregular and undesirable shape and appearance.

The present invention eliminates most of the deficiencies of the prior art and specifically eliminates or at least minimizes the problems caused by the excessive application of nailing pressure by providing a hinge-forming groove intermediate the nailing tab and panel for protectively isolating the panel from buckling and the other undesirable effects of excessive nailing pressure.

SUMMARY OF THE INVENTION

The present invention involves an interlocking slat assembly for use as siding, roofing and the like to cover inside or outside surface areas of a building, such as surfaces which may include foam board or other material susceptible of being crushed under the application of excess force. The interlocking slat assembly of the present invention includes a generally rectangular, surface-covering panel. An anchoring configuration is provided adjacent the upper end portion of a panel and a fastening tab adjacent the anchoring configuration and adapted to be secured to the building surface by fastening elements or the like passing therethrough is provided. A generally hook-like means integral with the lower end portion of the panel is provided for operatively engaging the anchoring configuration of the previously installed slat assembly to interlockingly position the slat assemblies one above the other in a partially overlapping manner. The slat assembly of the present invention includes means for interconnecting the anchoring configuration and the fastening tab and integral therewith. The interconnecting means includes a lateral groove-forming means extending substantially the entire width of the panel for establishing a hinge-like groove or joint between the fastening tab and the panel to isolate the panel from the effects of distortions and deformations in the fastening tab and building surface such as may be caused when the fastening elements which secure the fastening tab to the building surface are applied with excessive force.

In the slat assembly of the present invention, the groove is generally continuous and extends substantially the entire width of the panel. The cross sectional configuration of the groove may be U-shaped, V-shaped or the like and the depth of the groove is approximately one-half of the thickness of the panel in the preferred embodiment of the invention. The inclusion of the hinge joint-forming groove may be used with either the integral one-piece slat assembly of my earlier application or the self-compensating two-piece slat assembly of my later application and additional self-compensation may be provided, in either case, if the fastening tab includes corrugation means having alternate ridge and valley portions adapted to engagably receive the fastening elements therethrough for fixedly securing the attachment strip to the surface of the building being covered. The corrugation means cooperates with the building surface being covered and with the fastening elements for compensating for expansion and contraction of the strips with changing weather conditions and for achieving a spring-type buckle washer effect for maintaining a tight fit therebetween thereby preventing the slat assembly from working loose and eliminating rattling, noise and the like.

When the groove configuration of the present invention is utilized with my self-compensating two-piece slat assembly, the nature of the telescopic fit between the hook-like upper end portion of the panel and the channel-forming means of the separate attachment strip provides still additional means for compensating for expansions and contractions due to aging and exposure to the elements so as to prevent "oil canning" of the panel portions and greatly prolong the useful life of the slat assemblies. Additionally, the telescopic fit provides still additional isolation between the fastening tab and the panel by providing still another form of hinge-type interconnection therebetween.

The interlocking slat assemblies of the present invention allow for a tight mechanical interlock with partial overlap of the assemblies one above the other while simultaneously providing for expansion and contraction compensation to keep the slat assemblies secured to the surface of the building being covered and to prevent loose slat assemblies and eliminating noise and rattling while simultaneously protecting the panel portion of the slat assembly from buckling or other deformations or distortions caused by the excessive application of force to the fastening elements securing the nailing tab to the building surface.

The slat assembly of the present invention is useful as siding, roofing or the like, and is capable of serving a protective and/or decorative function on either an internal or an external surface of a building. The slat assembly of the present invention is a mechanically simple, low-cost article which is easy to install and easy to maintain while simultaneously providing self-compensation and hinge-type isolation to avoid the problems of the prior art.

Other advantages and meritorious features of the present invention will be more fully understood from the following detailed description of the drawings and the preferred embodiment, the appended claims and the drawings which are described briefly hereinbelow.

DESCRIPTION OF THE PREFERRED EMBODIMENTS

Figure 1:
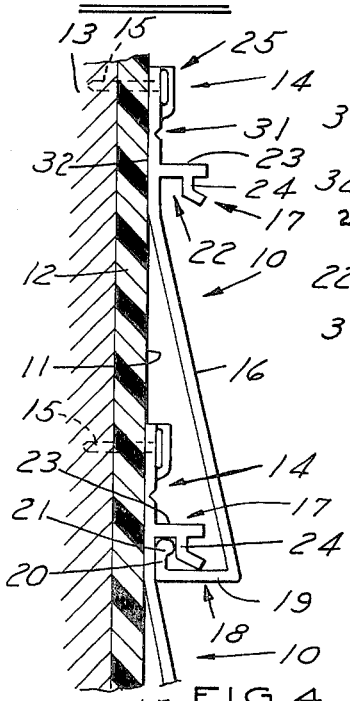
FIG. 1 is a fragmentary side view illustrating the roofing or siding slat assemblies of the present invention as they would be installed to cover a surface such as an insulation-type foam board on the side of a building.

FIG. 1 is a fragmentary side view illustrating one embodiment of the roofing or siding strips or slat assemblies 10 of the present invention as they would be installed to cover a surface 11 of an insulation-type foam wall board 12 secured to the side of a building 13. The fastening strip or nailing tab 14 of the lower slat assembly 10 is securely anchored to the surface 11 of the board 12 by means of a fastening element 15, such as a nail having a head, an elongated body portion and a pointed tip.

Figure 2:
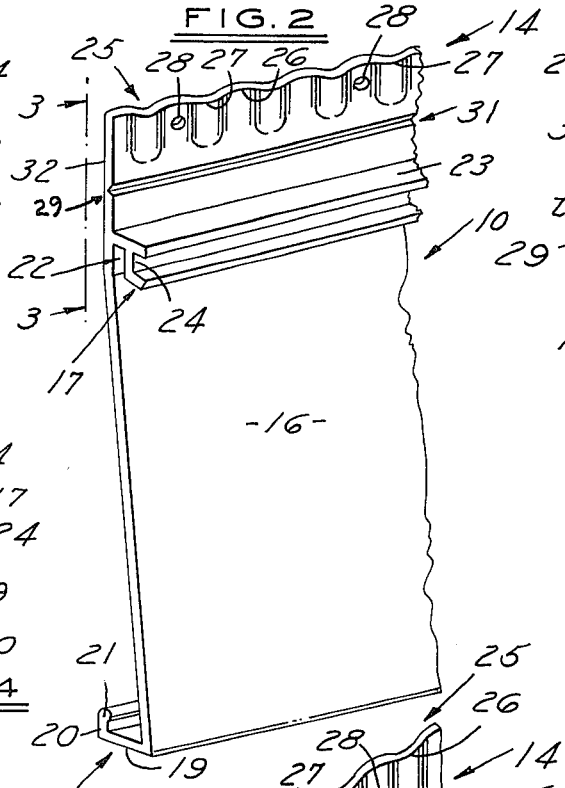
FIG. 2 is a fragmentary perspective view of one embodiment of the slat assembly of the present invention.

As illustrated in FIGS. 1 and 2, each of the slat assemblies 10 include a generally rectangular, substantially flat, surface-covering panel 16; a fastening tab 14 adapted to be nailed or otherwise secured to the surface 11 of the board 12; an anchoring configuration 17 adjacent the upper end portion of the panel 16 and intermediate the panel 16 and the nailing tab 14; and a generally hook-like configuration 18 integral with the lower end portion of the panel 16 for operatively engaging the anchoring configuration 17 of a previously installed slat assembly 10, such as the lower slat assembly 10 in FIG. 1, so as to interlock the slat assemblies 10 one above the other in a partially overlapping manner as shown in FIG. 1.

The lower hook-like configuration 18 is integral with the panel 16 and includes a generally L-shaped element having one leg portion 19 integrally abutting a distal end of the lower end portion of the panel 16 and disposed outwardly therefrom generally perpendicular to the plane of the interior surface of the panel 16. The bight of the L-shaped element is disposed upwardly toward the nailing tab 14 and the other leg portion 20 is disposed upwardly from the leg portion 19 may include a beaded lip 21 provided at the distal end of the leg portion 20, if desired. The hook-like configuration or the L-shaped element 18 serves to space the lower end of the panel 16 a predetermined distance away from the surface 11 of the board 12 or away from the surface of a previously installed slat assembly 10 while operatively engaging and mechanically interlocking with the anchoring configuration 17 of a previously installed slat assembly 10 so as to interlock the two slat assemblies 10 one above the other in a partially overlapping manner, as known in the art.

The anchoring configuration 17 is integral with and extends outwardly from the plane of the exterior surface of the panel 16 and is disposed a predetermined distance from the upper distal end of the slat assembly 10. The anchoring or interlocking configuration 17 serves to space the hook-like configuration 18 of a later installed slat assembly 10 a predetermined distance from the exterior surface of the panel 16 while operatively engaging the L-shaped element 18 to mechanically interlock the two slat assemblies 10 one above the other.

The anchoring configuration 17 defines a locking space 22 for receiving the beaded end 21 and leg 20 of the hook-like configuration 18 of the lower end of a later installed slat assembly 10 for mechanically interlocking the two slat assemblies 10. The locking space or recess 22 is defined by the space between a ledge portion 23 extending outwardly from the exterior surface of the panel 16 and generally perpendicular thereto and a second leg portion 24 integral with the ledge portion 23 and extending generally downwardly therefrom to define the locking space 22 between the exterior surface of the panel 16, the lower surface of the ledge portion 23 and the interior portion of the downwardly extending leg 24.

A shown in FIG. 2, the nailing tab or fastening strip 14 of the slat assembly 10 is provided with a plurality of corrugations 25 having alternate ridge portions 26 and valley portions 27 which are adapted to engagably receive the fastening elements 15 therethrough for fixedly securing the slat assemblies 10 to the surface 11 of the board 12 as previously described. The corrugations 25 are generally vertically aligned and extend a predetermined distance from the distal end of the upper portion of the fastening tab 14. If desired, nailing apertures 28 may be provided in either the ridge portion 26 or the valley portions 27 of the nailing strip 14, or both.

The corrugations 25 serve a dual function in the interlocking slat assembly 10 of the present invention. In the first place, the corrugations 25 provide a means whereby the slat assembly 10 is able to self-compensate for expansions and contractions such as may be produced in the strips 10 with changing weather conditions and/or aging. Simultaneously, the corrugations 25 provide a means whereby the fastening elements 15 secure that slat assemblies 10 to the surface 11 with a spring-type buckle washeror self-biasing effect for maintaining a tight fit between the slat assembly 10, the surface 11, and the fastening element 15 thereby preventing the slat assemblies from working loose from the surfaces 11 to eliminate noise such as rattling and the like.

Figure 3:
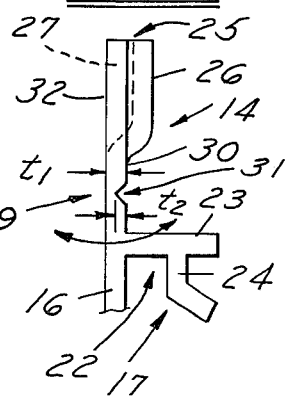
FIG. 3 is a blown-up, fragmentary sectional view of the top portion of the slat assembly of the present invention taken along view lines 3—3 of FIG. 2.

FIGS. 1, 2 and 3 show an intermediate interconnecting portion 29 integral with and disposed between the fastening tab 14 and the panel 16 of the slat assembly 10 of the present invention. The exterior surface 30 of the intermediate portion 29 is provided with a hinge-forming lateral groove 31 which, in the preferred embodiment of the present invention, has a depth "$t_2$" which is approximately one-half of the thickness "$t_1$" of the panel 16.

In the preferred embodiment of the present invention, the lateral groove 31 extends laterally or transversely across substantially the entire width of the intermediate portion 29 of the slat assembly 10. In the preferred embodiment the groove 31 is continuous and generally parallel to the upper and lower edge portions of the slat assembly 10 and perpendicular to the sides thereof.

When the slat assemblies 10 of the present invention are nailed via fastening elements 15 to the surface 11 of a board 12, such as a standard $\frac{5}{8}$ inch foam insulation board 12, excessive nailing pressure applied to the head of the fastening elements 16 may often crush the board 12 or cause depressions or deformations therein, cause uneven supporting surfaces beneath the undersurface 32 of the nailing tab 14 of the slat assembly 10 or cause deformation or distortion of the nailing tab 14 itself thereby causing the panel 16 to buckle or otherwise assume an irregular and undesirable shape and appearance.

The groove or score line 31 acts as a hinge to allow some play or yielding so as to isolate the main part of the slat assembly 10, the panel 16, from the distortion and deformation so as to protectively isolate the panel 16 from buckling and the like. After installation, of course, the groove 31 is concealably hidden beneath the vertically adjacent overlapping slat assembly 10.

Figure 4:
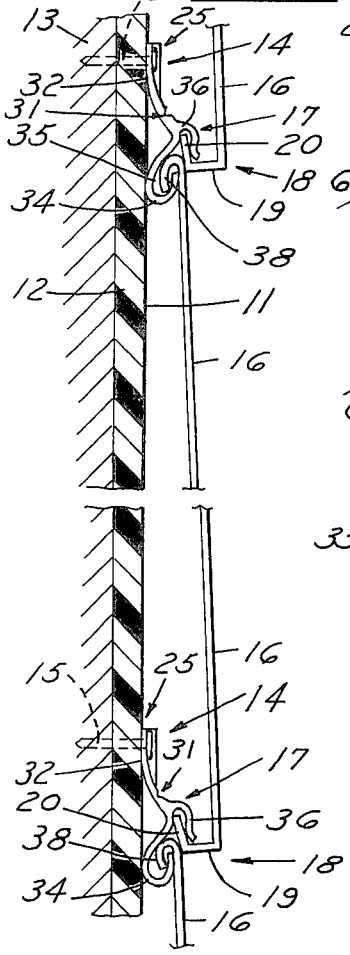
FIG. 4 is partial side view illustrating another embodiment of the roofing or siding slat assemblies of the present invention as they would be installed to cover a surface such as an insulation-type foam board on the side of a building.
Figure 5:
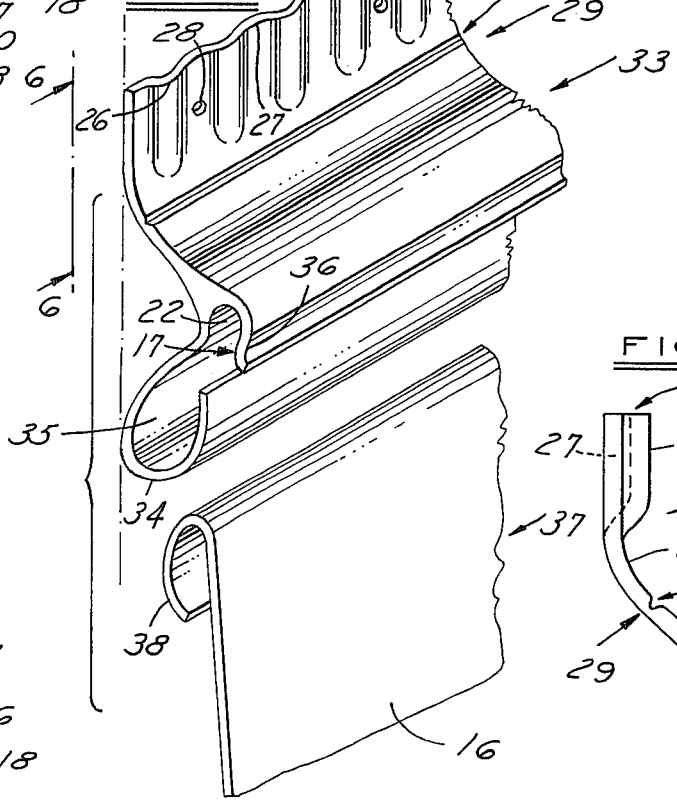
FIG. 5 is a fragmentary perspective view of a two-piece slat assembly wherein the separate attachment strip portion includes the hinge-forming groove of the present invention.
Figure 6:
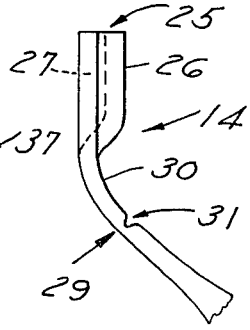
FIG. 6 is a blown-up fragmentary sectional view of the corrugated top portion of the attachment strip of FIG. 5 taken along view lines 6—6 thereof.

FIGS. 4, 5, and 6 represent an alternate embodiment of the present invention as applied to the two-piece self-compensating slat assemblies of my later filed copending application. In describing FIGS. 4, 5 and 6, similar elements receive like reference numerals.

Referring to FIGS. 4, 5 and 6, a slat assembly 10 is formed in two pieces or portions. The first portion 33 includes the nailing tab 14 integrally connected to the anchoring configuration 17 via the intermediate portion 29. Additionally, the first portion 33 includes a generally C-shaped channel-defining portion 34 which is integral with the intermediate portion 29 and forms a hollow central channel 35 therein. The anchoring configuration 17 forms a locking space or recess 22 which is defined by the exterior surface of the C-shaped channel-defining portion 34, and the generally U-shaped interior, bight of a groove-defining formation 36.

The second piece or portion 37 of the two-piece slat assembly 10 of FIGS. 4, 5 and 6 includes a hook-like slide configuration 38 integral with the upper end portion of the panel 16. The hook-like slide configuration 38 is adapted to be housably received within the hollow recess 35 of the C-shaped channel-defining configuration 34 of the first piece 33 so as to secure the first piece or attachment strip 33 to the second piece or panel portion 37 to allow for compensation for expansions and contractions in the panel 16 and to prevent "oil canning" thereby increasing the useful life of the slat assembly 10 of the present invention.

The recess 22 formed by the groove defining formation 36 of the anchoring configuration 17 of the attachment strip 33 is adapted to receive the second leg 20 of the L-shaped or hook-like configuration 18 at the lower end of the panel 16 as previously described.

Again, the intermediate portion 29 which interconnects the fastening strip 14 with the anchoring configuration 17 and C-shaped channel-defining portion 34 of the attachment strip or first portion 33 is provided with a lateral groove 31 extending substantially the entire width of the panel 16 to provide a similar hinge-like effect to isolate the panel 16 from buckling and the other harmful effects of deformation and distortion often produced in the nailing tab 14 and board 12 when the fastening elements 15 are secured with excessive nailing force.

In the embodiment of FIG. 3, the groove 31 is shown as having a generally V-shaped cross-sectional configuration whereas the embodiment of FIG. 6 is shown as having a substantially U-shaped cross-sectional configuration but any suitable configuration of groove or notch capable of providing the necessary hinge-type interconnection between the nailing tab 14 and the panel 16 can be used.

In the preferred embodiments described herein, the unitary slat assembly of FIG. 1–3 is a single piece of sheet aluminum although any suitable roofing or siding material could be used, and in the embodiment of FIGS. 4–6, the attachment strip or first piece 33 is preferrably an integrally formed piece of weather-resistant, resilient plastic material such as vinyl or the like although any suitable conventional material could be used and the second portion 37 including the panel 16 includes sheet aluminum although again, any suitable roofing or siding material could be used.

In the preferred embodiment, the groove 31 was continuous across the width of the panel although a series of aligned groove segments would probably perform as well. In the embodiment shown, the depth of the groove was approximately one-half the thickness of the panel and the width of the groove across the face of the slat assembly 10 was approximately 1/16 of an inch.

It will, of course, be realized that these dimensions in the materials set forth herein are as illustrative only. It will be realized that the slat assemblies of the present invention may be used both inside and outside of buildings and may be used for siding, roofing or other purposes, both functional and decorative. For example, the present invention may be used to simulate brick, stone or wood paneling and the like as well as for conventional aluminum siding.

With this detailed description of the specific apparatus used to illustrate the preferred embodiments of the present invention and the operation thereof, it will be obvious to those skilled in the art that various modifications can be made in the slat assembly of the present invention and in the various interlocking configurations therefor without departing from the spirit and scope of the present invention which is limited only by the appended claims.

I claim:

1. An interlocking slat assembly for use as siding, roofing, and the like to cover surface areas of a building comprising:

a generally rectangular surface-covering panel;

an anchoring configuration adjacent an upper end portion of said panel;

a fastening tab adjacent said anchoring configuration and adapted to be secured to said building surface by fastening elements or the like passing therethrough;

a generally hook-like means integral with a lower portion of said panel for operatively engaging the anchoring configuration of a previously installed slat assembly for interlockingly positioning the slat assemblies one above the other in a partially overlapping manner; and means for interconnecting said anchoring configuration and said fastening tab and integral therewith, said interconnecting means formed of a resilient material capable of deforming in the manner of a hinge and including a lateral groove of reduced thickness relative to the thickness of said anchoring configuration for establishing a hinge-type joint between said fastening tab and said panel to isolate said panel from the effects of distortions in said fastening tab and in said building surface such as may be caused when excessive force is applied to the fastening elements securing said fastening tab to said building surface.

2. The interlocking slat assembly of claim 1 wherein said lateral groove has a depth of approximately one-half the thickness of said panel.

3. The interlocking slat assembly of claim 1 wherein said lateral groove is continuous across substantially the entire width of said panel and has a generally U-shaped cross sectional configuration.

4. The interlocking slat assembly of claim 1 wherein said lateral groove is continuous across substantially the entire width of said panel and has a substantially V-shaped cross sectional configuration.

5. The interlocking slat assembly of claim 1 wherein said anchoring configuration and said fastening tab are integral with said panel and form a single unitary slat assembly.

6. The interlocking slat assembly of claim 1 wherein said nailing tab is integral with said anchoring configuration for forming a first portion of said slat assembly and includes a channel forming means adjacent the lower edge thereof, said panel and said hook-like means being integral with one another and forming a second separate portion of said slat assembly and including a channel-engaging configuration adjacent the upper portion thereof adapted to be housably received within said channel means of said first portion for operatively interconnecting said first and second portions to form a self-compensating two-piece slat assembly.

7. Theinterlocking slat assembly of claim 1 wherein said nailing tab includes corrugation means having alternate ridge and valley portions adapted to engagably receive fastening elements therethrough for fixedly securing said fastening tab to said building surface, said corrugation means cooperating with said building surface and said fastening elements for compensating for expansion and contraction of said slat assembly with changing weather conditions and for acheiving a spring-buckle washer effect for maintaining a tight fit therebetween thereby preventing said slat assembly from working loose and eliminating rattling and the like.

8. In an interlocking slat assembly having a nailing tab adapted to be secured to a building surface comprising insulation board or the like, said surfaces having a tendency to crush and otherwise deform under excessive nailing force, by fastening elements such as nails and the like, a panel for use as siding, roofing or the like for covering an area of the building surface, an anchoring configuration adjacent the upper end portion of the panel and a hook-like configuration at the lower end of the panel for operatively engaging the anchoring configuration of a previously installed slat assembly for interlocking vertically adjacent slat assemblies to position them on above the other in a partially overlapping manner, the improvement comprising groove-forming meamns intermediate said nailing tab and said panel forming of a resilient material capable of deforming in the manner of a hinge and including a lateral groove of reduced thickness relative to the thickness of said anchoring configuration for forming a hinge-type groove therebetween which allows yielding for isolating said panel from deformations and distortions such as buckling and the like caused by the fastening elements being driven too forcibly into said nailing tab so as to crush or otherwise deform portions of said building surface or said nailing tab.

9. The improved slat assembly of claim 8 wherein said nailing tab and said anchoring means are integrally connected and said hinge-type groove is disposed therebetween so as to be concealably covered by the next partially overlapping slat assembly to be installed vertically thereover.

10. The improved slat assembly of claim 8 wherein said groove extends substantially the entire width of said panel and has a depth of approximately one-half of the thickness of said panel to insure sufficient hinge-type joint isolation between said nailing tab and said panel.

* * * * *